US007190325B2

(12) United States Patent
Nagy

(10) Patent No.: US 7,190,325 B2
(45) Date of Patent: Mar. 13, 2007

(54) DYNAMIC FREQUENCY SELECTIVE SURFACES

(75) Inventor: Louis L. Nagy, Warren, MI (US)

(73) Assignee: Delphi Technologies, Inc., Troy, MI (US)

( * ) Notice: Subject to any disclaimer, the term of this patent is extended or adjusted under 35 U.S.C. 154(b) by 65 days.

(21) Appl. No.: 10/781,608

(22) Filed: Feb. 18, 2004

(65) Prior Publication Data

US 2005/0179614 A1 Aug. 18, 2005

(51) Int. Cl.
*H01Q 15/02* (2006.01)

(52) U.S. Cl. ..... 343/909; 343/756

(58) Field of Classification Search ..... 343/756, 343/909, 700 MS, 872, 792
See application file for complete search history.

(56) References Cited

U.S. PATENT DOCUMENTS

| | | | | |
|---|---|---|---|---|
| 5,502,453 | A * | 3/1996 | Tsukamoto et al. | 343/756 |
| 5,579,024 | A * | 11/1996 | Sureau | 343/909 |
| 5,621,423 | A * | 4/1997 | Sureau | 343/909 |
| 5,752,200 | A | 5/1998 | Meredith et al. | |
| 6,075,485 | A * | 6/2000 | Lilly et al. | 343/700 MS |
| 6,175,723 | B1 | 1/2001 | Rothwell, III | |
| 6,208,316 | B1 * | 3/2001 | Cahill | 343/909 |
| 6,212,242 | B1 | 4/2001 | Smith et al. | |
| 6,363,263 | B1 | 3/2002 | Reudink et al. | |
| 6,396,449 | B1 * | 5/2002 | Osterhues et al. | 343/754 |
| 6,396,451 | B1 * | 5/2002 | Wu et al. | 343/756 |
| 6,417,807 | B1 | 7/2002 | Hsu et al. | |
| 6,512,494 | B1 * | 1/2003 | Diaz et al. | 343/909 |
| 6,525,695 | B2 * | 2/2003 | McKinzie, III | 343/756 |
| 6,608,607 | B2 * | 8/2003 | Wu | 343/909 |
| 6,714,771 | B1 | 3/2004 | Nagy et al. | |
| 6,747,608 | B2 * | 6/2004 | Wu | 343/909 |
| 6,806,843 | B2 * | 10/2004 | Killen et al. | 343/795 |
| 6,842,609 | B2 | 1/2005 | Davis et al. | |
| 2002/0036718 | A1 | 3/2002 | Lee | |
| 2002/0167457 | A1 | 11/2002 | McKinzie, III et al. | |
| 2003/0100333 | A1 | 5/2003 | Standke et al. | |
| 2003/0103011 | A1 | 6/2003 | Rogers et al. | |
| 2003/0219035 | A1 | 11/2003 | Schmidt | |
| 2003/0228857 | A1 | 12/2003 | Maeki | |
| 2005/0012677 | A1 * | 1/2005 | Brown et al. | 343/909 |

FOREIGN PATENT DOCUMENTS

| | | |
|---|---|---|
| EP | 0539297 | 4/1993 |
| EP | 1120856 | 8/2001 |
| GB | 2335798 | 9/1999 |

OTHER PUBLICATIONS

J.E.Ross et al, "Numerical Simulation of a Self-Structuring Antennas Based on a Genetic Algorithm optimization Scheme," 2000 AP-S/URSI Symposium, Salt Lake City, UT, Jul. 2000.

(Continued)

*Primary Examiner*—Tan Ho
(74) *Attorney, Agent, or Firm*—Jimmy L. Funke

(57) ABSTRACT

An antenna system is disclosed. The antenna system includes at least one antenna element and an adaptable frequency-selective-surface responsive to operating characteristics of the at least one antenna element and/or surrounding environmental conditions.

39 Claims, 7 Drawing Sheets

OTHER PUBLICATIONS

C.M. Coleman et al., "Application of Two-Level Evolutionary Algorithms to Self-Structuring Antennas," 2001 URSI National Radio Science Meeting, Boston, MA, Jul. 2001.

C.M. Coleman et al., Self-structuring antennas, IEEE Antennas and Propagation Magazine, vol. 44(3), p. 11-23, Jun. 2002.

C.M. Coleman et al., Investigation of Simulated annealing, ant-colony optimization, and genetic algorithms for self-structuring antennas, IEEE Transactions on Antennas and Propagation, vol. 52(4), p. 1007-1014, Apr. 2004.

EP Search Report dated Jul. 15, 2005.

R.C. Johnson, "Antenna Engineering Handbook", Third Edition, 1993.

J.D. Kraus, "ANTENNAS", Second Edition, pp. 624-627 and 632-635, 1988.

General Motors R&D Center "Search", vol. 31, No. 1, Jul. 1997, pp. 1-6.

* cited by examiner

DYNAMIC FREQUENCY SELECTIVE SURFACES

RELATED APPLICATIONS

This application contains subject matter related to U.S. application Ser. No. 10/763,910 filed 23 Jan. 2004, now U.S. Pat. No. 6,950,629 B2 issued 27 Sep. 2005.

TECHNICAL FIELD

The present invention generally relates to frequency selective surfaces and, more particularly, to dynamically adjustable frequency selective surfaces.

BACKGROUND OF THE INVENTION

Automotive vehicles are commonly equipped with audio radios that receive and process signals relating to amplitude modulation/frequency modulation (AM/FM) antennas, satellite digital audio radio systems (SDARS) antennas, global positioning system (GPS) antennas, digital audio broadcast (DAB) antennas, dual-band personal communication systems digital/analog mobile phone service (PCS/AMPS) antennas, Remote Keyless Entry (RKE) antennas, Tire Pressure Monitoring System (TPM) antennas, and other wireless systems.

SDARS, for example, offer digital radio service covering a large geographic area, such as North America. Satellite-based digital audio radio services generally employ either geo-stationary orbit satellites or highly elliptical orbit satellites that receive uplinked programming, which, in turn, is rebroadcast directly to digital radios in vehicles on the ground that subscribe to the service. SDARS also use terrestrial repeater networks via ground-based towers using different modulation and transmission techniques in urban areas to supplement the availability of satellite broadcasting service by terrestrially broadcasting the same information. The reception of signals from ground-based broadcast stations is termed as terrestrial coverage. Hence, an SDARS antenna is required to have satellite and terrestrial coverage, and each vehicle subscribing to the digital service generally includes a digital radio having a receiver and one or more antennas for receiving the digital broadcast. The satellite and terrestrial coverage may be enabled via the implementation of a single antenna element, or alternatively, two antennas, each respectively receiving satellite and terrestrial-rebroadcast signals, which are typically referred to as a dual antenna element.

Besides SDARS, other vehicular communication systems may include one or more antennas to receive or transmit electromagnetic radiated signals, each having predetermined patterns and frequency characteristics. These predetermined characteristics are selected in view of various factors, including, for example, the ideal antenna radio frequency (RF) design, physical antenna structure limitations, and mobile environment conditions. Because these factors compete with each other, the resulting antenna design typically reflects a compromise as a result of the vehicular antenna system operating over several frequency bands (e.g., AM, FM, SDARS, GPS, DAB, PCS/AMPS, RKE, TPM, and the like) each having distinctive narrowband and broadband frequency characteristics and distinctive antenna pattern characteristics within each band. To accommodate these and other design considerations, a conventional vehicle antenna system can use several independent antenna systems while marginally satisfying basic design specifications.

A significant improvement in mobile antenna performance has been achieved by using an antenna that can alter its RF characteristics in response to changing electrical and other physical conditions. As seen in FIG. 1, one type of antenna system seen generally at 100 has been proposed to achieve this objective. The antenna system 100 is known as a self-structuring antenna (SSA) system. An example of a conventional SSA system is disclosed in U.S. Pat. No. 6,175,723 ("the '723 patent"), entitled "SELF-STRUCTURING ANTENNA SYSTEM WITH A SWITCHABLE ANTENNA ARRAY AND AN OPTIMIZING CONTROLLER," issued on Jan. 16, 2001 to Rothwell III, and assigned to the Board of Trustees operating Michigan State University. The SSA system 100 disclosed in the '723 patent employs antenna elements that can be electrically connected to one another via a series of switches to adjust the RF characteristics of the SSA system as a function of the communication application or applications and the operating environment. A feedback signal provides an indication of antenna performance and is provided to a control system, such as a microcontroller or microcomputer, that selectively opens and closes the switches. The control system is programmed to selectively open and close the switches in such a way as to improve antenna optimization and performance.

Conventional SSA systems, such as the SSA system 100, may employ several switches in a multitude of possible configurations or states. For example, an SSA system that has 24 switches, each of which can be placed in an open state or a closed state, can assume any of 16,777,216 ($2^{24}$) configurations or states. Assuming that selecting a potential switch state, setting the selected switch state, and evaluating the performance of the SSA using the set switch state takes 1 ms, the total time to investigate all 16,777,216 configurations to select an optimal configuration is 50,331.6 seconds, or approximately 13.98 hours. During this time, the SSA system loses acceptable signal reception. Search time associated with selecting a switch configuration for a conventional SSA system may be reduced by incorporating a memory device with the conventional SSA structure. The memory device as discussed above is described in currently pending and related patent application Ser. No. 10/763,910 and invention record file number DP-309795 by the same inventor of the present invention. Essentially, the memory device evaluates a reduced number of the possible switch configurations for the SSA when a station, channel, or band is changed to reduce search times and provide improved SSA performance.

As seen in FIGS. 2A and 2B, known frequency-selective-surfaces (FSS), which are seen generally at 200*a*, 200*b* may include a plurality of dipole elements 201 (FIG. 2A) arranged in a generally vertical direction or a planar slot array 203 (FIG. 2B) in a conductive surface. When the dipole elements 201 are resonating, the array is completely reflective, and, when the slot elements 203 are resonating, the conductive surface is completely transparent As a result, the dipole array 201 acts as a spatial band-rejection filter and the planar slot array 203 acts as a spatial band-pass filter. Accordingly, when transmitting radiation is blocked, signals relating to a certain polarization, such as vertical, horizontal, LHCP, right-hand-circular polarization (RHCP), or the like, are reflected, transmitted, or absorbed by the FSS.

Although adequate for most applications, conventional FSS, such as those seen in FIGS. 2A and 2B, are designed to provide a surface with fixed characteristics designed to meet a well-defined application. For example, as stated above, when a vehicular antenna systems includes AM, FM, SDARS, GPS, DAB, PCS/AMPS, RKE, TPM, and other frequency bands received by an SSA or non-SSA systems, the FSS is designed to only reflect, transmit, or absorb a signal at one specific frequency or polarization. Therefore, in one example, when a system operates an SDARS application receiving both LHCP celestial-transmitted signals and vertically-polarized terrestrial-retransmitted signals, conventional FSS would have a fixed surface electromagnetic characteristic for the LHCP or vertically-polarized signal (i.e. energy)—not both polarizations, nor at different frequency bands when a channel or station is changed, nor for changing environmental conditions, such as, for example, the pitch of a vehicle on a hill that effects the elevation angle of the antenna(s), or the location of a vehicle in a lossy location such that trees or tall buildings obstructs the line of sight of the received signal(s).

Accordingly, it is therefore desirable to provide an improved FSS that dynamically changes its surface characteristics for a plurality of frequency bands, polarizations, and changing environmental conditions.

SUMMARY OF THE INVENTION

The present invention relates to an antenna system. Accordingly, one embodiment of the invention is directed to an antenna system comprising at least one antenna element and an adaptable frequency-selective-surface responsive to operating characteristics of the at least one antenna element and/or surrounding environmental conditions.

BRIEF DESCRIPTION OF THE DRAWINGS

The present invention will now be described, by way of example, with reference to the accompanying drawings, in which.

DESCRIPTION OF THE PREFERRED EMBODIMENT

Figure 3:
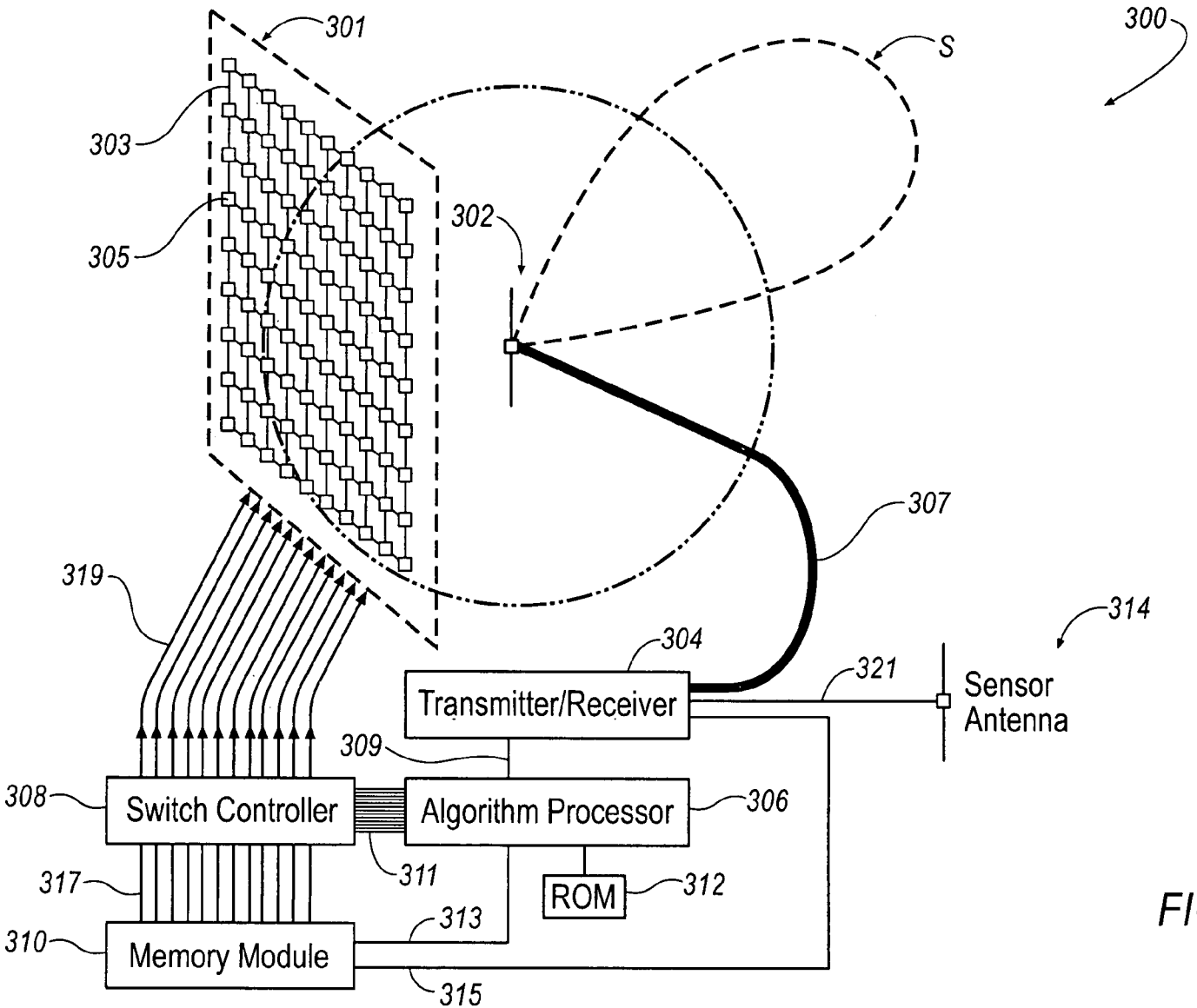
FIG. 3 illustrates a FSS according to an embodiment.
Figure 4:
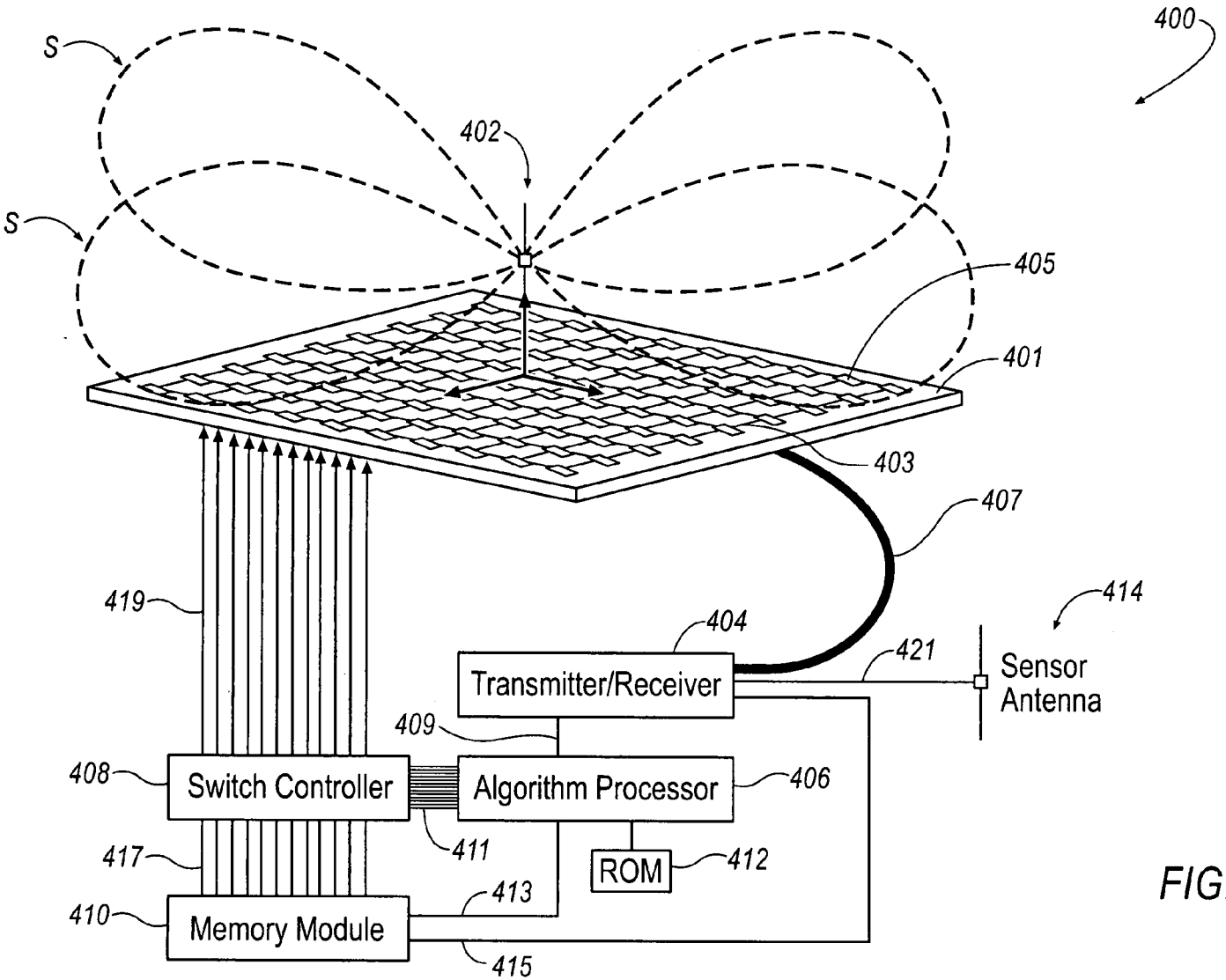
FIG. 4 illustrates an FSS according to another embodiment.
Figure 5:
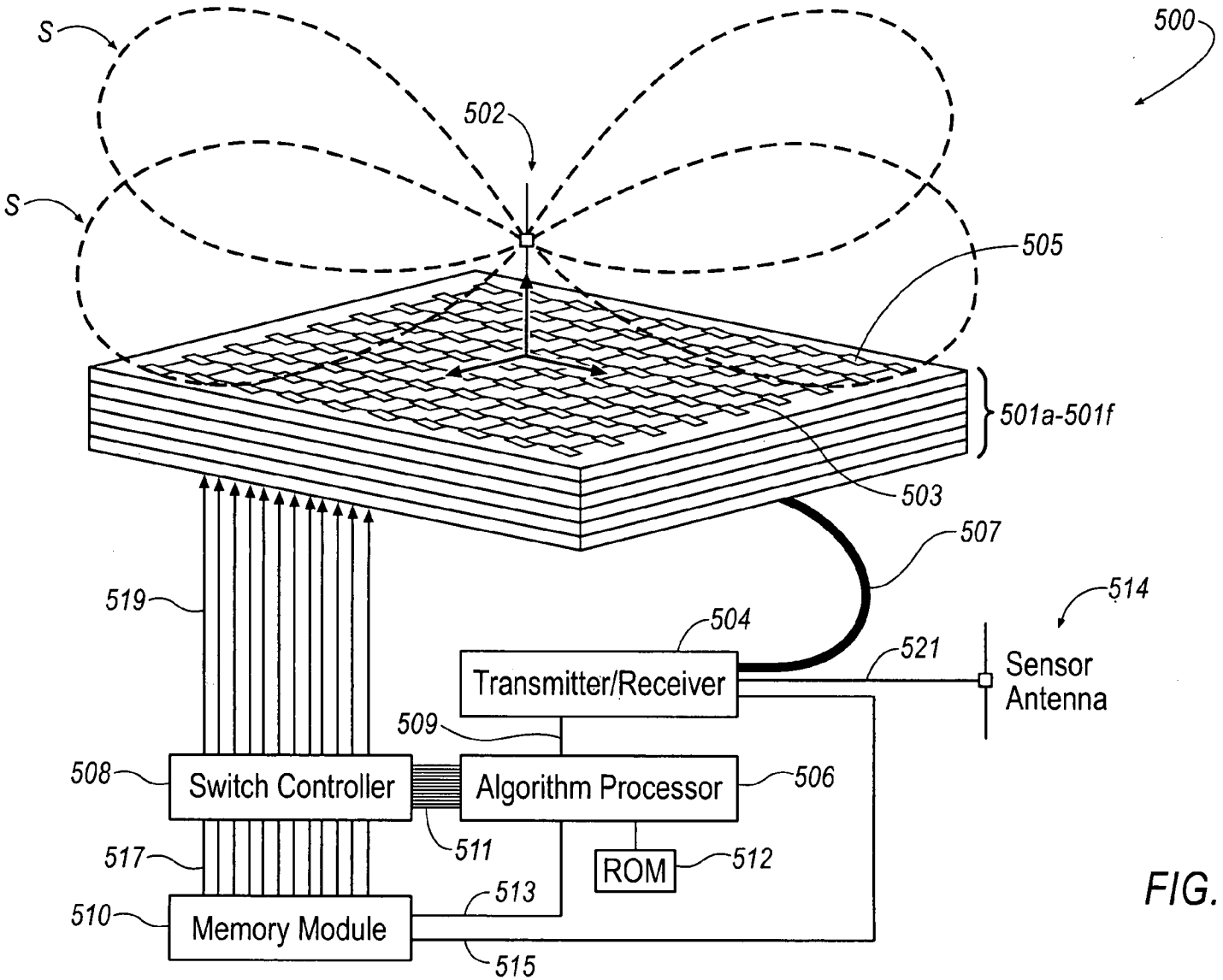
FIG. 5 illustrates an FSS according to another embodiment.

Referring generally to FIGS. 3–6H, the above described disadvantages are overcome and a number of advantages are realized by an inventive frequency-selective-surface (FSS) seen generally at reference numerals 300, 400, and 500 in FIGS. 3–5, respectively. As described in greater detail below, the FSS 300, 400, 500 is designed to change radio frequency (RF) surface characteristics in response to antenna characteristics and other environmental conditions. To achieve this, the FSS 300, 400, 500 incorporates a self-structuring capability in response to the operating characteristics of an antenna 302, 402, 502 and/or the environmental conditions. Accordingly, the FSS 300, 400, 500 is hereinafter referred to as a "self-structuring frequency selective surface" (SSFSS) 300, 400, 500. As opposed to the '723 patent, which teaches a self-structuring antenna (SSA) including a plurality of individual elements connected by switches to re-shape an antenna for reception of desired frequencies, the SSFSS 300, 400, 500 of the present invention recites a plurality of elements 303, 403, 503 electrically connectable by switches 305, 405, 505 incorporated into a surface 301, 401, 501, such as, for example, a ground plane including a dielectric substrate, that restructures the surface 301, 401, 501 for reflecting, transmitting, and absorbing signals defined by operating frequencies or polarizations. As a result, the SSFSS 300, 400, 500 continuously maximizes its RF characteristics in dependant fashion based upon on the operating antenna 302, 402, 502 and environment conditions.

The SSFSS 300, 400, 500, may be designed to receive any desirable signal, such as, for example, between the 800 MHz to 5.8 GHz range, including, but not limited to AMPS, which operates on the 824–849 and 869–894 MHz bands, DAB, which operates on the 1452–1492 MHz band, commercial GPS, which operates around 1574 MHz (L1 Band) and 1227 MHz (L2 Band), PCS, which operates on the 1850–1910 and 1930–1990 MHz bands, and SDARS, which operates on the 2.32–2.345 GHz band. However, AM/FM, which operates on the 540–1700 kHz and 88.1–107.9 MHz bands, and other similar antennas that operate on other lower frequencies may be included in the design as well. Referring initially to FIG. 3, a block diagram of the SSFSS 300 according to an embodiment is shown. The SSFSS 300 includes a surface 301 that is orientated in a generally parallel configuration with respect to the receiving antenna 302. Conversely, as seen in FIGS. 4 and 5, the surface 401, 501 is orientated in a generally perpendicular manner with respect to the antenna 402, 502. Explained in greater detail below with respect to its functionality, the SSFSS 500 includes a plurality of surfaces 501*a*–501*f*, as opposed to a single surface, as seen in FIGS. 3 and 4. Additionally, although planar, two-dimensional surfaces 301, 401, 501*a*–501*f* are shown, single- or three-dimensional surfaces may be incorporated as well. Although the above-described difficulties of prior art systems 200*a*, 200*b* have been described as applied to vehicular antenna systems, the SSFSS 300, 400, 500, embodiments of the invention are not limited to a vehicular antenna system. As such, the SSFSS 300, 400, 500 may be implemented as a standalone unit, such as, for example, a portable entertainment system.

In operation, a transmitter/receiver 304, 404, 504 receives a radiated electromagnetic signal, such as an RF signal, via the antenna 302, 402, 502 over line 307, 407, 507. Depending on the particular application, the radiated electromagnetic signal can be of any of a variety of types, including but not limited to AM, FM, SDARS, GPS, DAB, PCS/AMPS, RKE, TPM, and other frequency bands, such as, for example, a UHF or VHF television signal, or the like. Although illustrated as a single antenna element, the antenna 302, 402, 502 may include a dual antenna element for receiving, in one example, terrestrial-repeated and celestial signals in an SDARS application, or, alternatively, the antenna 302, 402, 502 may be a self-structuring antenna (SSA) as described in currently pending application Ser. No. 10/763,910 and DP-309795 that receives any desirable radiated electromagnetic signal(s). If the antenna 302, 402, 502 is a SSA, the SSA antenna 302, 402, 502 may utilize the elements seen at reference numerals 304–310 in a similar manner as described in U.S. application Ser. No. 10/763,910.

A switch controller 308, 408, 508 provides control signals to switches 305, 405, 505 to selectively open or close the switches 305, 405, 505 to implement particular surface configurations. The switch controller 308, 408, 508 is operatively coupled to the switches 305, 405, 505 via control lines 319, 419, 519. The switch controller 308, 408, 508 is also operatively coupled to a memory module 310, 410, 510 via a bus 317, 417, 517. The memory module 310, 410, 510 stores surface configurations or switch states and is addressable using lines 313, 413, 513 from an algorithm processor 306, 406, 506 or lines 315, 415, 515 from the transmitter/receiver 304, 404, 504. Algorithm processor 306, 406, 506 is interconnected with transmitter/receiver 304, 404, 504 by a line 309, 409, 509. It should be noted that the memory module 310, 410, 510 need not store all possible surface configurations or switch states. For many applications, it would be sufficient for the memory module 310, 410, 510 to store any desirable amount of configurations, such as, for example, up to several hundred possible surface configurations or switch states.

Any of a variety of conventional memory devices may comprise the memory module 310, 410, 510 including, but not limited to, RAM devices, SRAM devices, DRAM devices, NVRAM devices, and non-volatile programmable memories, such as PROM devices and EEPROM devices. Alternatively, the memory module 310, 410, 510 may also include a magnetic disk device or other data storage medium. The memory module 310, 410, 510 can store the surface configurations or switch states using any of a variety of representations. In some embodiments, each switch 305, 405, 505 may be represented by a bit having a value of 1 if the switch 305, 405, 505 is open or a value of 0 if the switch 305, 406, 505 is closed in a particular surface configuration. Accordingly, each surface configuration is stored as a binary word having a number of bits equal to the number of switches 305, 405, 505 included within the surface 301, 401, 501. The surface 301, 401, 501 may include any desirable amount of switches 305, 405, 505 and switching elements 303, 403, 503. For example, if seventeen switches 305, 405, 505 are included in the surface 301, 401, 501, each surface configuration would be represented as a 17-bit binary word.

In operation, the algorithm processor 306, 406, 506 selects a surface configuration appropriate to the operational state of the SSFSS 300, 400, 500 (i.e., the type of radiated electromagnetic signal received by the transmitter/receiver 304, 404, 504 or the particular frequency or frequency band in which the SSFSS 300, 400, 500 is operating). For example, the transmitter/receiver 304, 404, 504 may provide a control signal to the algorithm processor 306, 406, 506 or the memory module 310, 410, 510 that indicates the operational mode of the antenna 302, 402, 502, (i.e., whether the antenna 302, 402, 502 is to be configured to receive an AM, FM, SDARS, GPS, DAB, PCS/AMPS, RKE, TPM, or the like). The transmitter/receiver 304, 404, 504 may also generate the control signal as a function of the particular frequency or frequency band to which the transmitter/receiver 304, 404, 504 is tuned. The control signal may also indicate certain strength or directional characteristics of the radiated electromagnetic signal. For example, the transmitter/receiver 304, 404, 504 may provide a received signal strength indicator (RSSI) signal to the algorithm processor 306, 406, 506.

The algorithm processor 306, 406, 506 responds to the control signal by initiating a search process of the conceptual space of possible surface configurations to select an appropriate surface configuration. Rather than beginning at a randomly selected surface configuration each time the search process is initiated, the algorithm processor 306, 406, 506 starts the search process at a switch configuration that is known to have produced acceptable surface characteristics under the prevailing operating conditions at some point during the usage history of the SSFSS 300, 400, 500. For example, the algorithm processor 306, 406, 506 may address the memory module 310, 410, 510 to retrieve a default switch configuration, such as elements 303, 403, 503 having symmetry, for a given operating frequency. Symmetry of the elements 303, 403, 503 helps in running through matrices with equations so the computations stay within certain bounds to restrain computation time by identifying a geometry at switches 305, 405, 505. If the default configuration produces acceptable surface characteristics, the algorithm processor 306, 406, 506 uses the default switch configuration. On the other hand, if the default switch configuration no longer produces acceptable surface characteristics, the algorithm processor 306, 406, 506 searches for a new switch configuration using the default switch configuration as a starting point. Once the algorithm processor 306, 406, 506 finds the new switch configuration, the algorithm processor 306, 406, 506 updates the memory module 310, 410, 510 via the lines 313, 413, 513 to replace the default switch configuration with the new switch configuration.

Regardless of whether the algorithm processor 306, 406, 506 selects the default switch configuration or another switch configuration, the algorithm processor 306, 406, 506 indicates the selected switch configuration to the switch controller 308, 408, 508 via lines 311, 411, 511. The algorithm processor 306, 406, 506 communicates with the memory module 310, 410, 510 and the switch controller 308, 408, 508 to determine if the memory module 310, 410, 510 data should be communicated to the switch controller 308, 408, 508 via the bus 317, 417, 517 such that the binary word stored in the memory module 310, 410, 510 corresponds to the selected surface configuration determined by the algorithm processor 306, 406, 506. If the algorithm processor 306, 406, 506 determines that the memory module data does not need to be loaded, then the algorithm processor 306, 406, 506 may alternatively suggest a new switch configuration on its own. In either method, the switch controller 308, 408, 508 receives the binary word via the line 311, 411, 511 or bus 317, 417, 517 and, based on the binary word, outputs appropriate switch control signals to the switches 305, 405, 505 via the control lines 319, 419, 519. The switch controller 308, 408, 508 signals selectively open or close the switches 305, 405, 505 as appropriate, thereby forming the selected surface configuration.

The algorithm processor 306, 406, 506 is typically configured to operate with one or more types of processor readable media, such as a read-only memory (ROM) device 312, 412, 512. Processor readable media can be any available media that can be accessed by the algorithm processor 306, 406, 506 and includes both volatile and non-volatile media, removable and non-removable media. By way of example, and not limitation, processor readable media may include storage media and communication media. Storage media includes both volatile and non-volatile, removable and non-removable media implemented in any method or technology for storage of information such as processor-readable instructions, data structures, program modules, or other data. Storage media includes, but is not limited to, RAM, ROM, EEPROM, flash memory or other memory technology, CD-ROM, digital video discs (DVDs) or other optical disc storage, magnetic cassettes, magnetic tape, magnetic disk storage or other magnetic storage devices, or any other medium that can be used to store the desired information and that can be accessed by the algorithm processor 306, 406, 506. Communication media typically embodies processor-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above are also intended to be included within the scope of processor-readable media.

Additionally, a feedback sensor, such as a sensor antenna 314, 414, 514, may be connected to the transmitter/receiver 304, 404, 504 at line 321, 421, 521. Essentially, according to one embodiment, the sensor antenna 314, 414, 514 provides an indication of SSFSS system 300, 400, 500 performance. The feedback signal provided over line 321, 421, 521 may be used by a microprocessor, the memory module 310, 410, 510, the algorithm processor 306, 406, 506, or switch controller 308, 408, 508 to appropriately alter the SSFSS surface 301, 401, 501 by opening and closing the various switches 305, 405, 505. In another embodiment, the sensor antenna 314, 414, 514 may harvest environmental condition data, such as for example, position data from, for example, GPS. More specifically, in an implementation example, the sensor antenna 314, 414, 514 may supplement the SSFSS system 300, 400, 500 with data corresponding to the vehicle's position to be utilized when the vehicle encounters a lossy reception area, such as for example, when the signal is obstructed by an area with trees or tall buildings, or alternatively, when the vehicle is pitched on a hill, effecting the elevation angle of the antenna. As a result, the SSFSS system 300, 400, 500 may cross-reference the GPS data with the above-described antenna data to cause the controller 308, 408, 508 to register a surface configuration that gives best results for the particular location or environmental condition of the SSFSS system 300, 400, 500.

In another embodiment, as seen in FIG. 5, layered SSFSS surfaces 501*a*–501*f* are shown. Although only six layered surfaces are shown, the invention is not limited to six surfaces and any desirable amount of surfaces may be included in the design of the invention. Additionally, although the surfaces 301, 401, and 501*a*–501*f* are shown as generally planar surfaces, the surfaces 301, 401, 501*a*–501*f* may be non-planar surfaces, such as, in the shape of a lens to provide additional control of the lobbing of the signals, S. The layered surfaces 501*a*–501*f* are referred to as a 'stack volume' comprising discrete surfaces. Essentially, each surface 501*a*–501*f* provides a different electromagnetic characteristic that permits more dynamic operation of the SSFSS system 500 when the antenna(s) 502 operate at different frequency bands or polarizations.

In another embodiment of the invention, the 'stack volume' of surfaces may also be connected to each other via switches perpendicularly traversing each surface 501*a*–501*f* to form a cubic volume rather than being discrete surfaces. Accordingly, by positioning the stack volume as illustrated, the stack volume is considered to partially encapsulate the antenna 502. In yet another embodiment, rather than partially encapsulating the antenna, the stack volume may include additional surfaces forming 'walls' and a 'lid' that entirely encapsulates the antenna, thereby forming a 'stack volume shell' about the antenna 502.

Figure 5A:
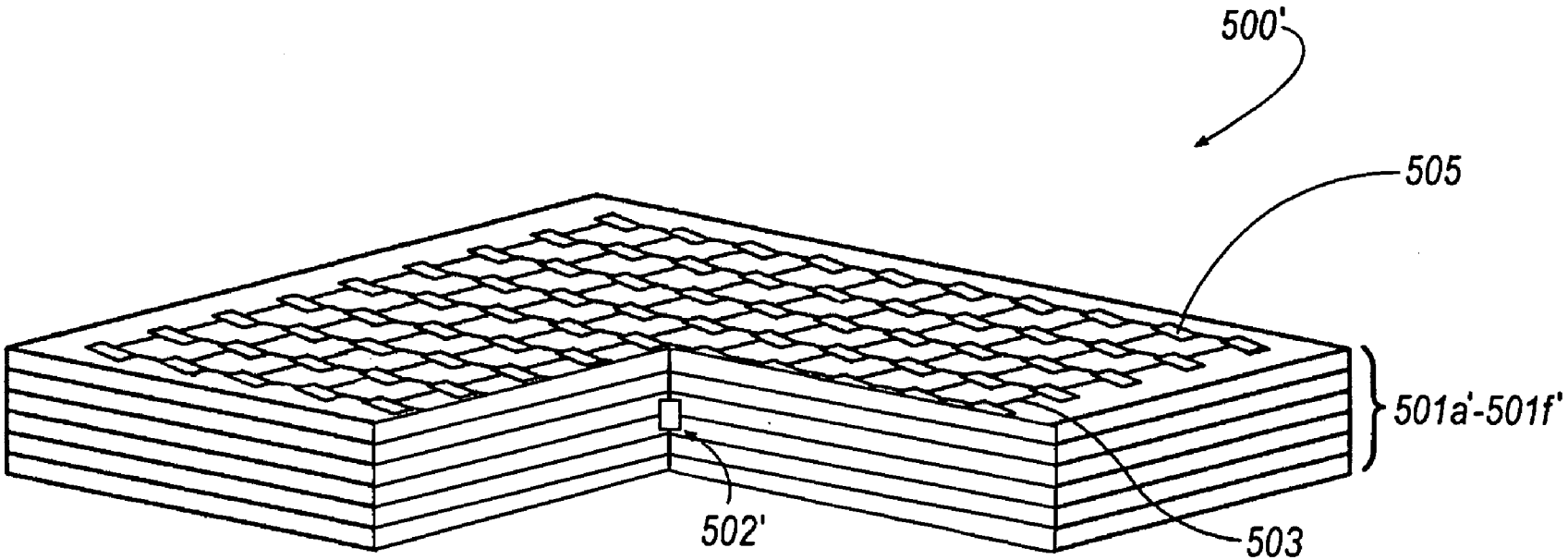
FIG. 5A illustrates a variant of the FSS of FIG. 5, with a cut-away on an enlarged scale, wherein an antenna is encapsulated within a three dimensional volume defined by the plurality of layered surfaces.
Figure 6A:
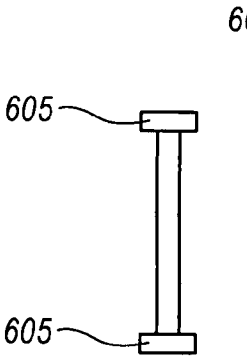
FIGS. 6A–6H illustrate examples of element geometries applicable to the FSS in FIGS. 3–5.
Figure 6B:
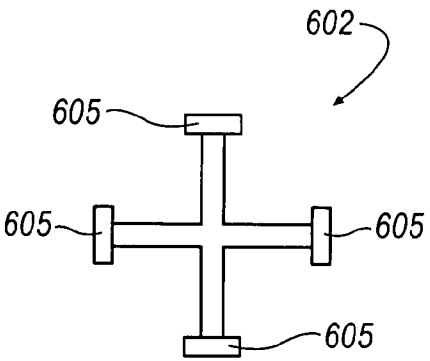
Figure 6C:
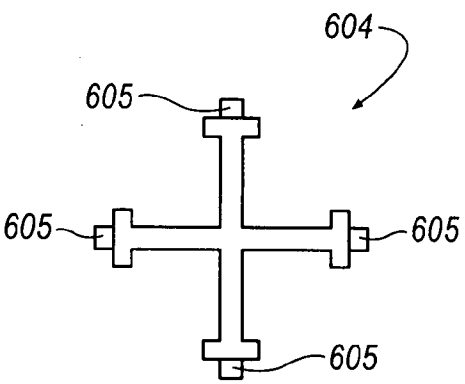
Figure 6D:
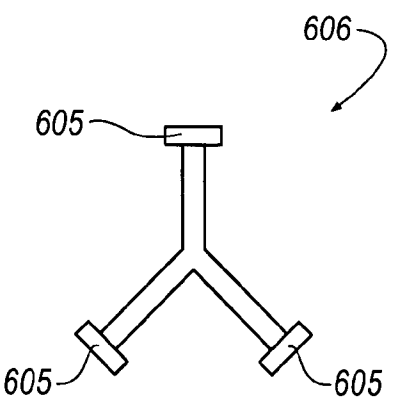
Figure 6E:
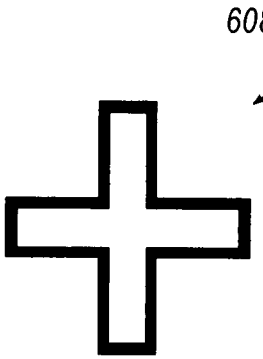
Figure 6F:
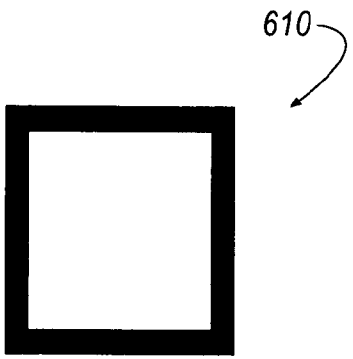
Figure 6G:
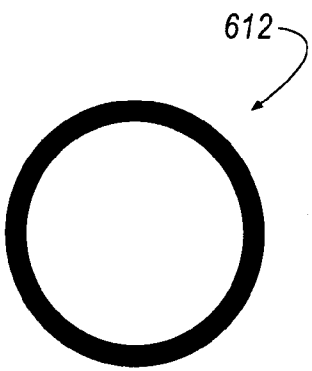
Figure 6H:
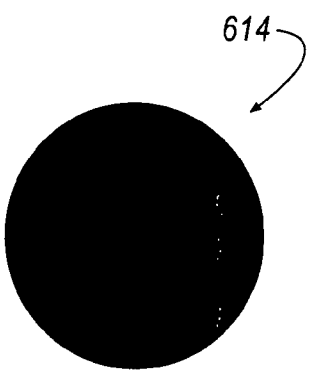

Referring to FIG. 5A, a self structuring —frequency selective surface 500' is formed by a stack volume of surfaces 501'*a*–501'*f*, which operate substantially as described in regard to the device of FIG. 5. The only significant difference is that an antenna 502' is partially or entirely encapsulated within the three-dimensional volume defined by surfaces 501'*a*–501'*f*.

Although a single surface, such as the surface 401, may be adequate when the antenna 402 is operating at fewer frequencies, the single surface 401 may only incorporate thirty-two switches 405. Conversely, when the antenna 502 may cover multiple frequency bands or polarizations, hundreds of switches 505 may have to be incorporated in a single surface 501. In such a scenario, processing time of the SSFSS system 500 may be undesirable increased to find an appropriate surface 501 including an optimum reflective, transmittive, or absorbing effect. Therefore, by stacking multiple surfaces 501*a*–501*f* each dedicated to a specific frequency, the number of switches 505 may be limited to thirty-two switches 505 or less, and, as a result, the time to calculate an optimum surface characteristic is limited and maintained. As a result, layered surfaces 501*a*–501*f* broadens the overall bandwidth of the SSFSS system 500 and improves roll-off characteristics. Additionally, by limiting the number of switches 505 in a multi-surface SSFSS system 500, the manufacturing process of the SSFSS 500 may be simplified as well.

In an application-specific example, multiple layering of three surfaces 501*a*–501*c* may be provided for an SDARS application for the antenna 502 while also incorporating a GPS application relating to the sensor antenna 514. Surface 501*a* may be dedicated to LHCP SDARS signals, surface 501*b* may be dedicated to RHCP GPS signals, and surface 501*c* may be dedicated to vertically-polarized terrestrial signals. In operation, all three surfaces may be operated at the same time, or alternatively, one or two surfaces may be deactivated at any given time by the algorithm processor 506 via the transmitter/receiver 504.

Figure 1:
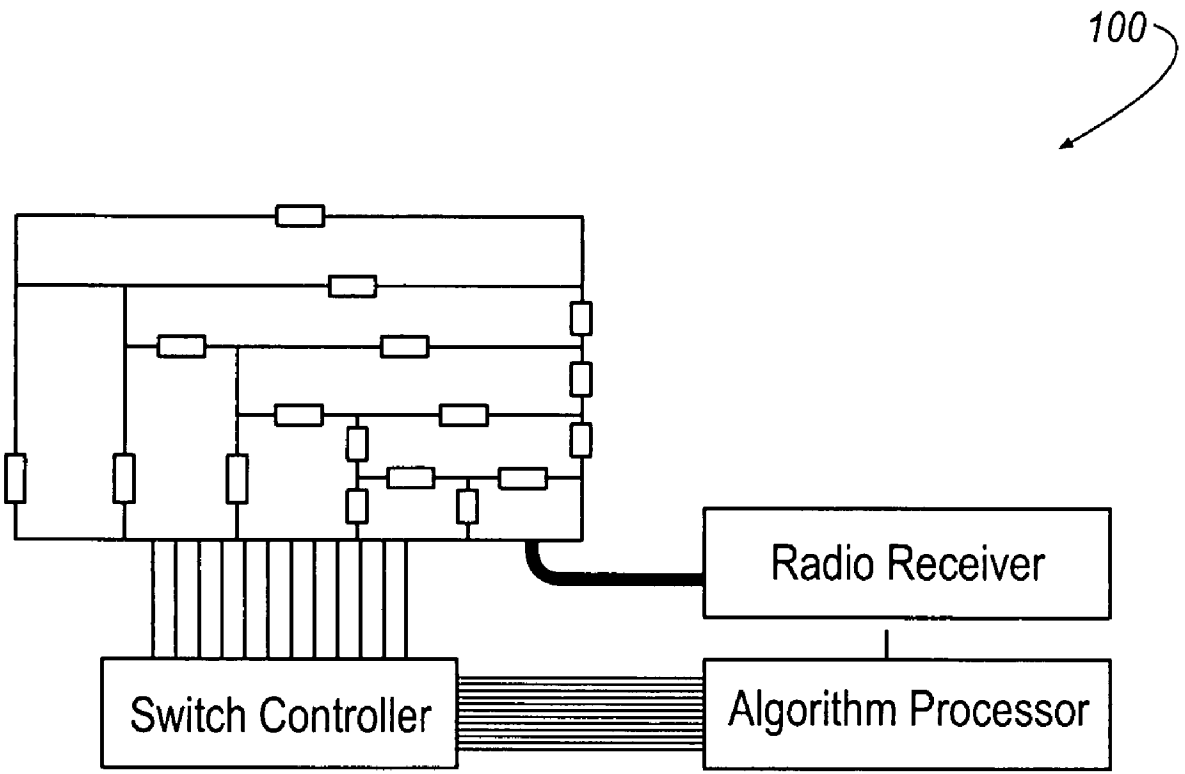
FIG. 1 (PRIOR ART)
FIG. 1 illustrates a known self-structuring antenna (SSA) system.
Figure 2B:
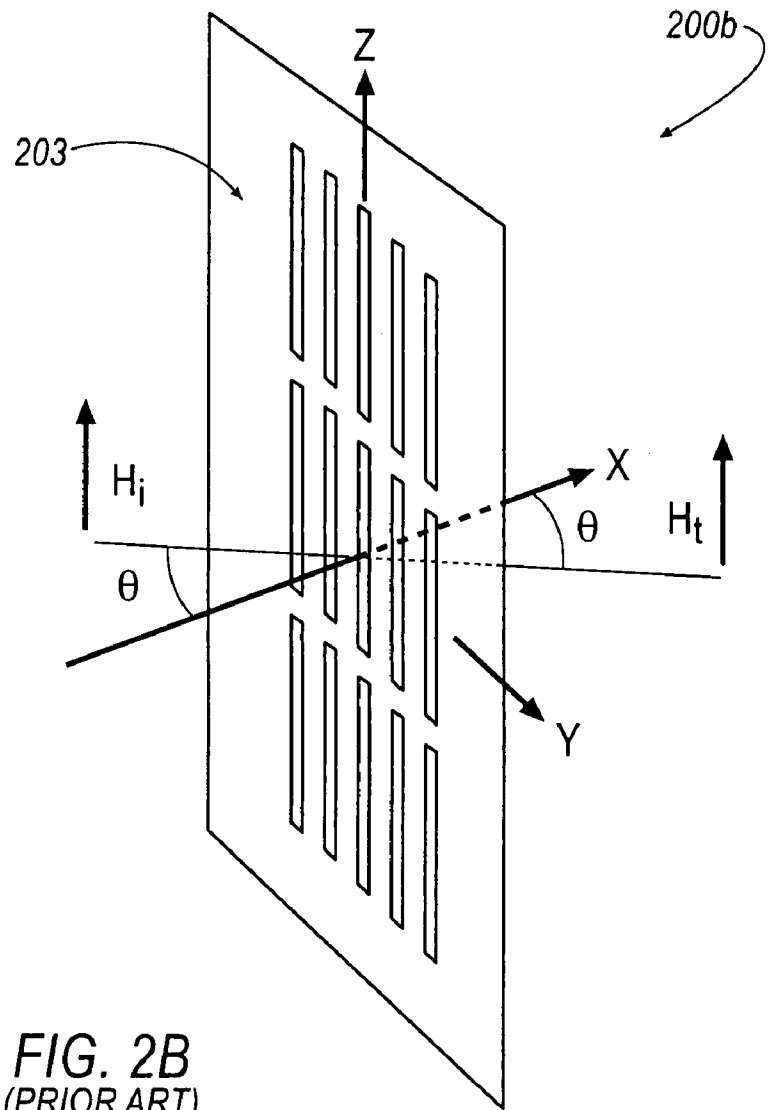
FIG. 2B (PRIOR ART)
FIGS. 2A and 2B illustrate known frequency-selective surfaces (FSS)
Figure 2A:
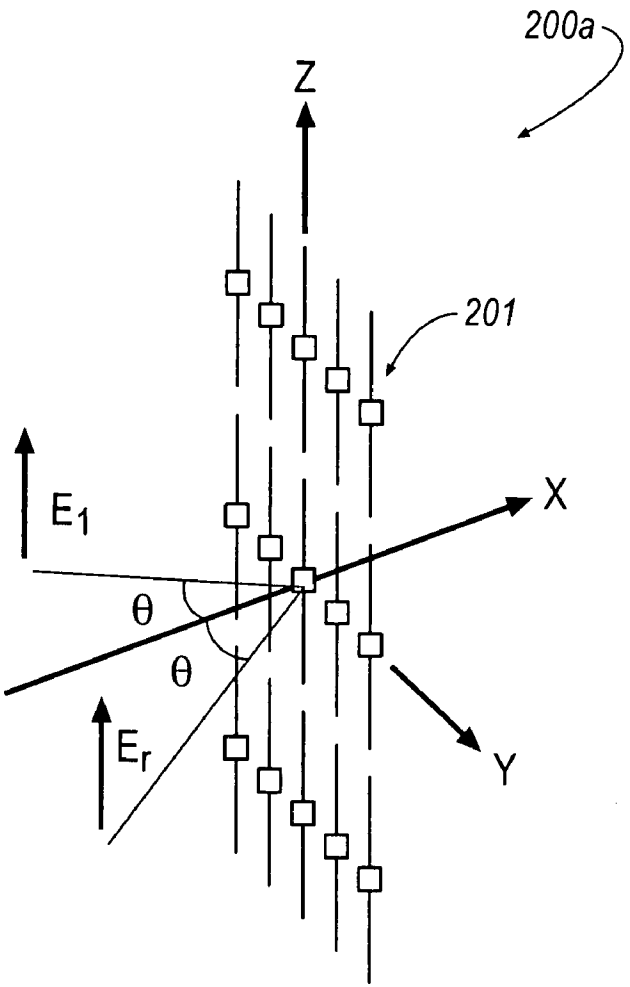
FIG. 2A (PRIOR ART)

Referring now to FIGS. 6A–6H, various geometries of the switching elements 303, 403, 503 may be incorporated into the design of the SSFSS 300, 400, 500 are seen generally at 600–614, respectively. In addition to the element geometries 600–614, dielectric materials, and element spacing may be used to alter the polarization and frequency characteristics of the SSFSS systems 300, 400, 500. As seen in FIGS. 6A–6D, element geometries 600–606 include switch contacts 605 to control the electric field whereas element geometries 608–612 may be incorporated as a slot in a surface, that is, similar to the rectangular slots seen in FIG. 2B, to control the magnetic field. Geometry 614 is a solid surface. Geometry 600, which is in the shape of a rod, may be a dipole antenna including a length to operate at a certain frequency. The cross geometry 602 may be two dipole antennas orientated for dual polarization (i.e. LHCP, RHCP, elliptical polarization, slant polarization). The tabbed cross geometry 604 may be implemented for broad-banding effects. The Y-shaped geometry 606 may be implemented for elliptical polarization effects. As discussed above, the opened geometries, such as the open cross 608, the open square 610, and open circle 612 affect the magnetic field. The solid plate 614, on the other hand, may behave in a similar fashion as a patch antenna (not including a feed point) when a substrate (not shown) is incorporated underneath it.

Accordingly, as seen in FIGS. 4 and 5, when the surface 401, 501*a*–501*f* is conductive the signals, S, may lobe towards the surface 401, 501*a*–501*f* in a nearly horizontal fashion. Alternatively, as seen in FIG. 3, when the surface 301 is a high impedance surface, the signals, S, may lobe away from the surface. As such, depending on the geometry of the surface and/or antenna configuration, the signal, S, may lobe toward or away from the surface. Thus, lobbing characteristics of the electromagnetic signal may be selectively controlled as it impedes on the surface 301, 401, 501*a*–501*f*. As such, the SSFSS systems 300, 400, 500 may selectively reflect, transmit, or absorb various forms of energy of various polarizations and frequencies. More specifically, dipole elements 303, 403, 503 may be desired to be approximately λ/2 (half wavelength) to make the SSFSS 300, 400, 500 responsive to one frequency or a harmonic frequency. In another embodiment of the invention, impedance elements (i.e. resistive, capacitive, inductive, or a combination thereof) may be incorporated with dipole elements 303, 403, 503 to cause a reflective, transmittive, or absorbing surface.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A dynamic antenna system, comprising:

at least one antenna element;

a frequency-selective-surface responsive to operating characteristics of the at least one antenna element and/or surrounding environmental conditions;

controller means operative to generate control signals to effect reconfiguration of frequency specific reflectivity and/or absorption characteristics of said surface; and processor means operative to direct operation of said controller means in response to signals received from said at least one antenna element.

2. The dynamic antenna system according to claim 1, wherein the frequency selective surface reflects, transmits, or absorbs signals defined by operating frequency bands, polarizations, or environmental conditions.

3. The dynamic antenna system according to claim 2, wherein the reflected, transmitted, or absorbed frequencies includes AMPS, which operates on the 824–849 and 869–894 MHz bands, DAB, which operates on the 1452–1492 MHz band, commercial GPS, which operates around 1574 MHz (L1 Band) and 1227 MHz (L2 Band), PCS, which operates on the 1850–1910 and 1930–1990 MHz bands, SDARS, which operates on the 2.32–2.345 GHz band, and AM/FM, which operates on the 540–1700 kHz and 88.1–107.9 MHz bands.

4. The dynamic antenna system according to claim 1, wherein the at least one antenna establishes a reference point for orientating the frequency selective surface.

5. The dynamic antenna system according to claim 4, wherein the frequency selective surface is orientated in a parallel configuration with respect to the at least one antenna.

6. The dynamic antenna system according to claim 4, wherein the frequency selective surface is orientated in a perpendicular configuration with respect to the at least one antenna.

7. The dynamic antenna system according to claim 1, wherein the surface is a two-dimensional surface.

8. The dynamic antenna system according to claim 1, wherein surface is further defined to include a plurality of surfaces responsive to operating a plurality of characteristics of the at least one antenna element and/or surrounding environmental conditions.

9. The dynamic antenna system according to claim 1, wherein the surface defined a three-dimensional volume.

10. The dynamic antenna system according to claim 9 wherein the three-dimensional volume partially encapsulates the at least one antenna.

11. The dynamic antenna system according to claim 9 wherein the three-dimensional volume entirely encapsulates the at least one antenna.

12. The dynamic antenna system according to claim 1, wherein the surface is a low impedance surface that lobes signals towards or away from the surface.

13. The dynamic antenna system according to claim 1, wherein the surface is a high impedance surface that lobes signals toward or away from the surface.

14. The dynamic antenna system according to claim 1, wherein the surface is an absorbing surface that lobes toward or away from the surface.

15. The dynamic antenna system according to claim 1, wherein the surface is a matching surface that passes signals through the surface.

16. A dynamic antenna system, comprising:

at least one antenna element;

a frequency-selective-surface responsive to operating characteristics of the at least one antenna element and/or surrounding environmental conditions, said adaptable frequency selective surface including a plurality of electrically connectable elements and a plurality of switches that, when in an open state, disconnects the elements, or when in a closed state, connects to the elements to permit altering of the radiation characteristics of the frequency selective surface;

a transmitter/receiver that receives/transmits an electromagnetic signal;

a switch controller that provides control signals for the switching elements to selectively open or close the switches;

a memory module operatively coupled to the switch controller that stores surface configurations or switch states; and an algorithm processor that directs operation of the switch controller in a responsive manner via signals received by the at least one antenna.

17. The dynamic antenna system according to claim 16, wherein the algorithm processor selects a surface configuration appropriate to the operational state of the surface.

18. The dynamic antenna system according to claim 16, wherein the transmitter/receiver provides a control signal to the algorithm processor or the memory module that indicates the operational mode of the antenna.

19. The dynamic antenna system according to claim 16, wherein the transmitter/receiver generates a control signal that indicates strength or directional characteristics of the transmitted, received, or absorbed electromagnetic signal as a function of the particular frequency to which the transmitter/receiver is tuned.

20. The dynamic antenna system according to claim 16, wherein the transmitter/receiver may provide a received signal strength indicator signal to the algorithm processor.

21. The dynamic antenna system according to claim 16, wherein the algorithm processor responds to the control signal by initiating a search process of the conceptual space of possible surface configurations to select an appropriate surface configuration.

22. The dynamic antenna system according to claim 16, wherein the algorithm processor starts the search process at a switch configuration that produced acceptable surface characteristics during past usage of the antenna system.

23. The dynamic antenna system according to claim 16, wherein the algorithm processor addresses the memory module to retrieve a default switch configuration.

24. The dynamic antenna system according to claim 23, wherein the default switch configuration are a symmetrical configuration of the elements.

25. The dynamic antenna system according to claim 23, wherein, if the default configuration produces acceptable surface characteristics, the algorithm processor uses the default switch configuration, or, if the default switch configuration no longer produces acceptable surface characteristics, the algorithm processor searches for a new switch configuration using the default switch configuration as a starting point.

26. The dynamic antenna system according to claim 16, wherein, once the algorithm processor finds the new switch configuration, the algorithm processor updates the memory module to replace the default switch configuration with the new switch configuration.

27. The dynamic antenna system according to claim 16, wherein the algorithm processor indicates the selected switch configuration to the switch controller, and, in response to the indication of the selected switch configuration, the switch controller addresses the memory module to access information stored in the memory module corresponding to the selected surface configuration.

28. The dynamic antenna system according to claim 27, wherein the switch controller, upon receiving the information stored in the memory module signals the opening or closing of the switches.

29. The dynamic antenna system according to claim 16, wherein a sensor antenna connected to the transmitter/receiver provides an indication of system performance.

30. The dynamic antenna system according to claim 29, wherein the sensor antenna harvests environmental condition data from a global positioning signal to provide position data to inform the antenna system of a poor reception area.

31. The dynamic antenna system according to claim 16, wherein the elements are dipole elements which comprise:

impedance elements to cause a reflective, transmittive, or absorbing surface for various frequency bands, polarizations, and environment conditions.

32. A method for dynamically optimizing an antenna system, comprising the steps of:

providing at least one antenna element;

providing a frequency-selective-surface responsive to operating characteristics of the at least one antenna element and/or surrounding environmental conditions;

providing controller means operative to generate control signals to effect reconfiguration of frequency specific reflectivity and/or absorption characteristics of said surface; and providing processor means operative to direct operation of said controller means in response to signals received from said at least one antenna element.

33. The method according to claim 32, further comprising the steps of:

disposing within the frequency-selective-surface a plurality of electrically connectable elements; and disposing within the frequency-selective-surface a plurality of switches that, when in an open state, disconnects the elements, or when in a closed state, connects to the elements to permit altering of the radiation characteristics of the frequency selective surface.

34. The method according to claim 32, further comprising the step of reflecting, transmitting, or absorbing signals defined by operating frequency bands, polarizations, or environment conditions.

35. A method for dynamically optimizing an antenna system, comprising the steps of:

providing at least one antenna element;

altering a frequency-selective-surface responsive to operating characteristics of the at least one antenna element and/or surrounding environmental conditions;

reflecting, transmitting, or absorbing signals defined by operating frequency bands, polarizations, or environment conditions;

receiving a radiated electromagnetic signal from a transmitter/receiver;

providing a control signal from a switch controller to control an open or closed position of the switches;

storing surface configurations or switch states in a memory module operatively coupled to the switch controller; and responsive to signals received by the at least one antenna, directing operation of the switch controller from commands sent from an algorithm processor.

36. The method according to claim 35, wherein the directing operation step further comprises:

starting a search process via the algorithm processor to provide a switch configuration including acceptable surface electromagnetic characteristics gleaned during past usage of the antenna system.

37. The method according to claim 36, wherein the directing operation step further comprises:

indicating, via the algorithm processor, the selected switch configuration to the switch controller, and, responsive to the indicating step, addressing the switch controller from a switch configuration stored in the memory module corresponding to a selected surface configuration.

38. A method for dynamically optimizing an antenna system, comprising the steps of:

providing at least one antenna element;

altering a frequency-selective-surface responsive to operating characteristics of the at least one antenna element and/or surrounding environmental conditions; and harvesting environmental condition data from a sensor antenna.

39. The method according to claim 38, wherein the environmental condition data harvested during the harvesting step is global positioning data that provides position data.

* * * * *